United States Patent [19]

Renaud et al.

[11] 4,175,676

[45] Nov. 27, 1979

[54] APPARATUS FOR AUTOMATICALLY FEEDING COLLAR STAYS

[76] Inventors: Ronnie C. Renaud, Rte. 1, Liberty, S.C. 29675; Jerry D. Goins, 404 Laurel Rd., Easley, S.C. 29640

[21] Appl. No.: 838,010

[22] Filed: Sep. 29, 1977

[51] Int. Cl.[2] ..... B65G 59/04; B65H 5/14; B23Q 7/04

[52] U.S. Cl. ..... 221/211; 271/14; 271/108; 414/121; 414/752

[58] Field of Search ..... 221/210, 211; 214/8.5 D, 1 BT; 271/11, 12, 13, 14, 15, 108; 112/113

[56] References Cited

U.S. PATENT DOCUMENTS

| | | | |
|---|---|---|---|
| 2,661,948 | 12/1953 | Montgomery | 271/12 |
| 2,815,948 | 12/1957 | Watter | 271/14 |
| 2,954,900 | 10/1960 | Brubaker | 221/211 |
| 3,158,367 | 11/1964 | Tarbuck | 271/11 X |
| 3,194,551 | 7/1965 | Herr et al. | 271/14 |
| 3,411,640 | 11/1968 | Wallis | 214/1 BT X |
| 3,724,687 | 4/1973 | Marschke et al. | 214/8.5 D |

FOREIGN PATENT DOCUMENTS

| | | | |
|---|---|---|---|
| 936651 | 9/1963 | United Kingdom | 414/752 |

*Primary Examiner*—Robert J. Spar
*Assistant Examiner*—Edward M. Wacyra
*Attorney, Agent, or Firm*—Bailey, Dority & Flint

[57] ABSTRACT

An automatic feeder apparatus is disclosed for feeding collar stays and the like to an associated machine including a first fluid cylinder having a reciprocating piston rod and a second fluid cylinder carried by the piston rod of the first fluid cylinder. The second fluid cylinder includes a reciprocating piston rod on which a suction device is carried which includes a pair of suction tubes having a suction end and a discharge end with air being introduced intermediate the ends to create the suction at the suction ends. A master solenoid valve controls delivery of a pressurized fluid to the fluid cylinders and cooperates with a systematic arrangement of in-line valves which are actuated by the movement of the suction device to provide an automatic sequence for pick-up and delivery of a collar stay.

17 Claims, 6 Drawing Figures

2
80a
24b
14b
14
90
92
40
44
98
48
32a
96
50
32
10
10c
76
76a
42
28
28a
N.O.
N.O.
46
49
16
30a
51
34
94
78
78a
54
18
N.C.
30
a
b
20
56
56
24b
2
58
26
71
70
34
73
59
60
24a
74
72
22
62
64

APPARATUS FOR AUTOMATICALLY FEEDING COLLAR STAYS

BACKGROUND OF THE INVENTION

The invention relates to the automatic feeding of collar stays at a sewing station. In a typical construction of a shirt collar, a pointed collar stay is sewed between the inner and outer collar fabric panels. It is both time-consuming and tedious for the sewing machine operator to manually pick up a collar stay and place the collar stay in position for sewing. It thus becomes an expedient to have some means of automatically feeding a collar stay to closely adjacent the position of the collar in which the stay is to be sewn. A collar stay is normally made of a very thin material making it extremely difficult to pick up when on a flat surface.

Prior devices for feeding various articles have been developed which utilize suction to pick up the article and deposit it at a desired location. One such device is shown in U.S. Pat. No. 2,849,847 which discloses a container capping apparatus which utilizes a vacuum applied to a suction cup for picking up a circular cap and, subsequently, ejecting the cap by applying pressurized air to the suction cup when in a discharge position. The suction cup is pivoted by means of a rather elaborate cam/linkage assembly from an inverted cap pick-up position to a cap discharge position as containers are conveyed therebeneath. However, this apparatus does not lend nor suggest itself to the feeding of articles such as collar stays which are comparatively thin and lightweight, particularly in view of the problems encountered with dispensing such articles from an overhead magazine. The suction cup device would not be readily effective for picking up elongated and narrow articles such as stays which present a much smaller surface for the application of a suction than the circular surface area of a container cup.

Another example of an article feeder device is shown in U.S. Pat. No. 3,086,486 which discloses a hopper-type feeder having a feed chute for feeding buttons to an exact location of a sewing machine.

U.S. Pat. No. 3,483,833 discloses another button feeding attachment for a sewing machine which utilizes air cylinders for operating jaws to grasp the buttons and position the buttons in alignment with the needle of a sewing machine.

SUMMARY OF THE INVENTION

It has been found that an automatic feeder apparatus for feeding collar stays to an associated sewing device can be had by providing a first fluid cylinder having a pair of inlets, a reciprocating piston rod extending therefrom, and a carriage means carried by the piston rod. A second fluid cylinder having an inlet and a reciprocating piston rod extending therefrom is carried by means of the carriage means and the piston rod of the first fluid cylinder for movement therewith. A suction device is carried by the piston rod of the second cylinder for picking up a collar stay from an associated magazine. A first valve is provided having a first position for delivering a fluid from a pressurized fluid source to one of the inlets of the first cylinder and the inlet of the second cylinder to move the suction device in first and second directions, respectively, to a stay pick-up position. The first valve has a second position for delivering the fluid to the other of the inlets of the first cylinder to move the suction device in a third direction opposite to the first direction to a stay delivery position.

A conduit means connects the first valve and the inlets of the first and second fluid cylinders. A second valve is connected in the conduit means between the first valve means and the inlet of the second cylinder responsive to movement of the suction device in the first direction for terminating fluid delivery to the second cylinder.

A third valve is connected in the conduit between the first valve means and the other inlet of the first cylinder responsive to movement of the suction device in a fourth direction opposite to the second direction for allowing delivery of air to the other inlet from said first valve means.

A fourth valve is provided for controlling delivery of a fluid to the suction device which is responsive to movement of the suction device to the delivery position for terminating fluid flow to the suction device.

Accordingly, an important object of the present invention is to provide pneumatic feeder apparatus for automatically feeding collar stays to sewing machines at a precise location so that little or no manual pick up of the stay is required.

Another important object of the present invention is to provide a pneumatic feeder apparatus for feeding collar stays to an associated sewing machine which requires little, if any, attention from the sewing machine operator and may be operated fully automatically.

Another important object of the present invention is to provide an automatic stay feeder apparatus for feeding collar stays to a sewing machine which may be utilized as an attachment to an existing sewing machine.

Still another important object of the present invention is to the provision of a pneumatic stay feeder apparatus having a suction device for positively picking up a collar stay and maintaining the stay in alignment for feeding into a hopper delivery chute.

Yet another important object of the present invention is to provide an automatic stay feeder apparatus having a suction device for picking up a stay operated by a pair of air cylinders which are controlled by a systematic arrangement of valves automatically and sequentially actuated by successive movement of the suction device to provide an automatic sequence from pick-up to delivery.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 1:
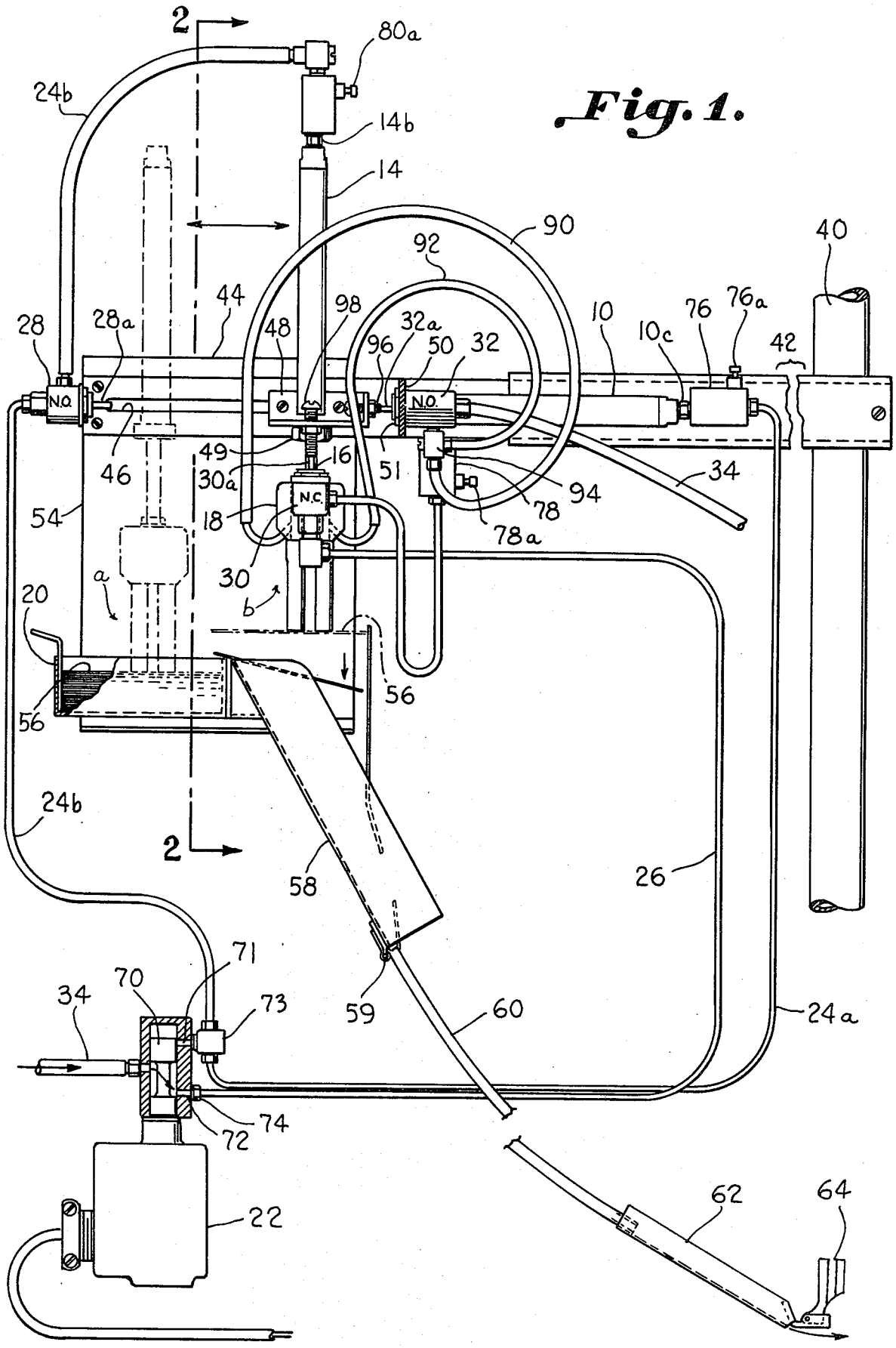
FIG. 1 is a front elevational view illustrating a pneumatic feeder device for automatically feeding collar stays constructed in accordance with the present invention.
Figure 2:
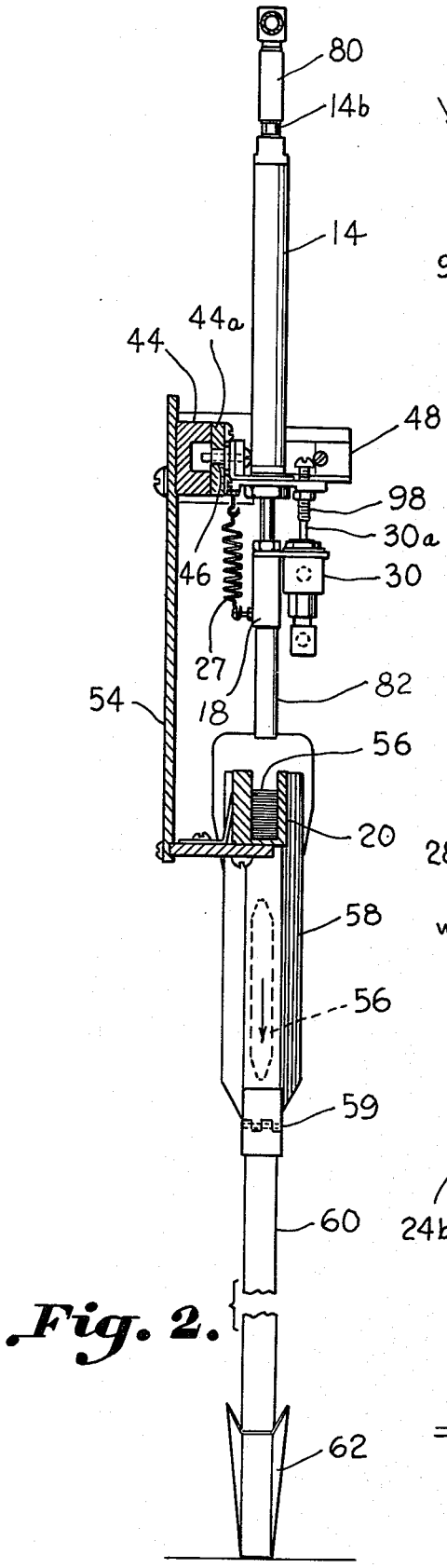
FIG. 2 is a sectional view taken along 2—2 of FIG. 1.

The invention relates to an apparatus for automatically feeding collar stays to a proximate area of the needle of a sewing machine so that the stay may be sewn into the collar of a shirt eliminating the need of pick-up by hand. In one form of the invention, the feeder apparatus is provided in the form of an attachment which may be readily adapted for use at a sewing station and may be used either by fully automatic or manual control by the sewing machine operator.

Referring to the drawings, an automatic feeder apparatus is illustrated as including a first fluid cylinder 10 having a reciprocating piston rod 12 and a second fluid cylinder 14 carried by the piston rod 12 having a reciprocating piston rod 16 extending therefrom. A suction device 18 is carried adjacent the end of piston rod 16 for picking up a collar stay from an associated magazine 20. The fluid cylinders provide means for carrying the suction device 18 between a stay pick-up position "a" and a delivery position "b" in successive movements.

Control means for controlling the carrier means and movement of the suction device includes a first valve means provided by a two-position solenoid valve 22 having a first position for delivering a fluid from a pressurized fluid source to an end 10*a* of cylinder 10 and end 14*a* of cylinder 14 to move the suction device 18 in respective first and second directions. The solenoid valve 22 has a second position for terminating delivery of the fluid to the cylinder ends 10*a* and 14*a* and for delivering the fluid only to the end 10*b* of cylinder 10 for returning the suction device 18 in a direction opposite to the first direction. A conduit line 24*a* connects the solenoid valve 22 to an inlet 10*c* of the fluid cylinder 10 and a conduit 24*b* connects valve 22 to an inlet 14*b* of cylinder 14. A conduit line 26 connects the solenoid valve 22 and a second inlet 10*d* of fluid cylinder 10. The cylinder 10 may be conventional double-action air motor cylinder operable in opposing directions by admission of air to either inlet 10*c* or 10*d*. The cylinder 14 is preferably a conventional single-action air motor cylinder operable in one direction by admission of air to inlet 14*b* and in the opposite direction by a return spring 27.

The control means for effecting controlled successive movements of the suction device further includes a second valve means, provided by a normally open valve 28, connected in the conduit line 24*b* between the solenoid valve 22 and the cylinder inlet 14*b* for controlling delivery of the fluid thereto. A third valve means is provided by a normally closed valve 30 connected in the conduit line 26 between valve 22 and the cylinder inlet 10*d* for controlling the delivery of fluid thereto. A fourth valve means is provided by a normally open valve 32 which is connected by means of a conduit line 34 to a source of pressurized fluid which is supplied by a supply line 36 and a pressure regulator and filter 38. The fourth valve 32 supplies pressurized fluid to the suction device 18. The valves 28, 30, and 32 are conventional two-way or two-position type valves which are mechanically actuated and switched to a position opposite to their normal position by depression of the respective switch pins 28*a*, 30*a*, and 32*a*. The valves provide switch means which are to be actuated in sequence in response to the successive movements of the suction device 18 affording fully automatic control thereof.

Means for supporting or attaching the stay feeder apparatus at a sewing station may be provided by a vertical post 40 and a horizontal brace 42 which may be adjustably affixed to the post 40. Post 40 may be clamped to the sewing machine table or other associated structure whereby the feeder apparatus is arranged to feed the stays to a desired location. The fluid cylinder 10 is affixed to the brace member 42 in any suitable manner. A tubular back arm 44 forms a part of the horizontal support structure as an extension of the brace arm 42 and includes a front plate 44*a* having an elongated slot 46 in which a carriage member 48 slides for rectilinear motion. The carriage member 48 is attached to the reciprocating plunger rod 12 of the fluid cylinder 10 and provides a means by which the fluid cylinder 14 is carried by the plunger rod 12. As illustrated, fluid cylinder 14 is carried by the carriage member 48 by means of a threaded portion which extends through an opening in carriage member 48 with a nut member 49 securing the threaded portion to the carriage member. In a like manner, the fluid cylinder 10 is secured to a flange 50 of the brace 42 and secured thereto by means of a nut member 51. The carriage member 48 is secured to a threaded end of the plunger 12 by means of nut members 52. The suction device 18 is secured to a threaded end 16*a* of piston rod 16.

A back plate 54 is secured to the back arm 44 by which the magazine 20 is carried containing a stack of collar stays 56 directly below the suction device 18. Also carried by the back plate 54 adjacent the magazine 20 is a stay hopper and chute device 58 for delivering a stay when released by the suction device to a shirt collar positioned below the foot of a sewing machine (not shown). The chute device includes a tubular chute member 60 pivotably connected to hopper 58 at 59 which opens into an open-top channel 62 which may be positioned for delivery of a stay directly onto the collar at a proper location for being sewn between collar panels. A hinged presser foot 64 is provided in the form of a conventional sewing machine foot and is soldered to the end of channel chute 62. In use, the presser foot 64 is attached to the presser bar of the sewing machine in place of the original presser foot whereby the stay is guided directly underneath the foot and sewing needle for being stitched to the collar liner. The brace arm 42 may be pivoted horizontally and moved vertically about post 40 to adjust the final delivery location.

As illustrated, the solenoid valve 22 may be controlled by an electrical timer 66 which is actuated by a manual foot switch 68 to begin the sequence of the automatic stay feeder. The solenoid valve 22 may be a conventional three-way solenoid valve having a spool valve member 70 which communicates an outlet opening 71 with a source of pressurized fluid coming from the regulated supply line 34 when in a first position and which communicates the pressurized fluid from supply line 34 to a second outlet 72 when in a second position. The first valve outlet 71 is connected to conduit lines 24*a* and 24*b* by means of a T-coupling 73. The conduit line 26 is connected to the second outlet 72 by means of a conventional coupling 74. Thus, when controlled by the timer 66 in a manner to be more fully hereinafter explained, the valve means 22 delivers air to the inlet 10*c* of cylinder 10 and the inlet 14*a* of cylinder 14 when energized in a first position and delivers pressurized fluid to the conduit line 26 to the inlet 10*d* of cylinder 10 when de-energized and in a second position. Fluid delivery is terminated to the inlet 10*c* of cylinder 10 and inlet 14*a* of cylinder 14 when the valve 22 is de-energized.

The inlets to the fluid cylinders 10 and 14 are preferably provided with flow-regulator means 76, 78 and 80 which, in their simplest form, may be provided by variable orifices whose sizes may be varied by adjustable threaded screws 76*a*, 78*a* and 80*a*, respectively. This allows for regulating the rate of delivery of the pressurized fluid to the respective cylinder inlets so that the rate of movement of the plunger rod controlled thereby can be adjusted to provide for the desired timing of movement of the suction device 18.

Figure 3:
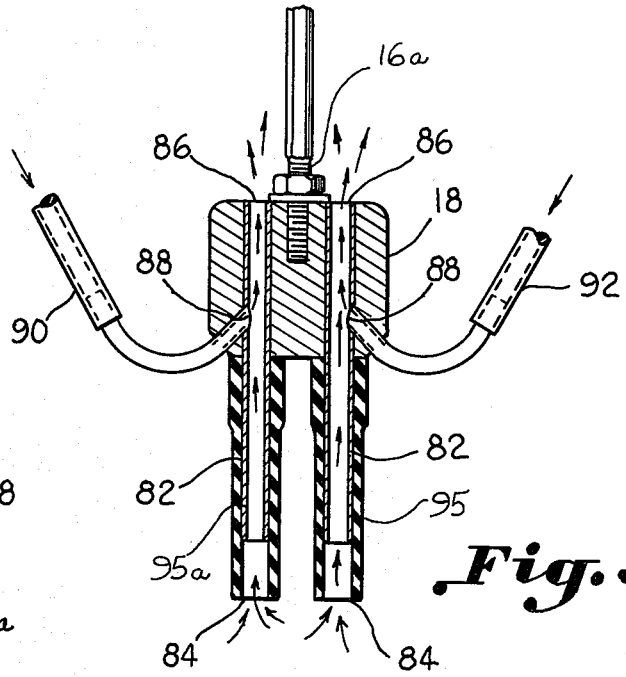
FIG. 3 is a elevational cut-away view illustrating a suction device constructed in accordance with the present invention.

Referring now in more detail to FIG. 3, the suction device 18 is illustrated as including a pair of suction tubes 82 which are identical. Each suction tube includes a suction end 84 and a pressure or discharge end 86. A fluid delivery inlet 88 is provided intermediate the discharge and suction ends for delivery of air through the suction tubes outwardly through the discharge end 86 creating a suction at the ends 84. The fluid delivery inlets 88 are connected to the valve 32 by means of conduit lines 90 and 92 which are connected to the valve outlet by a suitable coupling member 94. Thus, pressurized fluid is delivered by means of the valve 32 from the regulated supply line 34 to the suction device 18. Thus, the suction device and fluid cylinders may be operated by a single common source of pressurized fluid eliminating the need for a separate negative pressurized fluid or vacuum source.

Each suction tube 82 includes a flexible hose sleeve 95, such as a synthetic rubber, fitted over an inner rigid tube 95*a* with the flexible hose extending slightly past the end of the rigid tubing. This provides a resilient suction tip for contacting each stay forming a seal thereagainst and maintaining the suction on each stay. The arrangement of two tubes 82 provides for suction contact at two spaced points on each stay whereby the stay is positively picked up from the magazine 20 and maintained in straight alignment for delivery into hopper chute 58.

In the preferred embodiment, the pressurized fluid utilized to operate the stay feeder apparatus is compressed air which is also utilized to provide a suction in the device 18.

Figure 4:
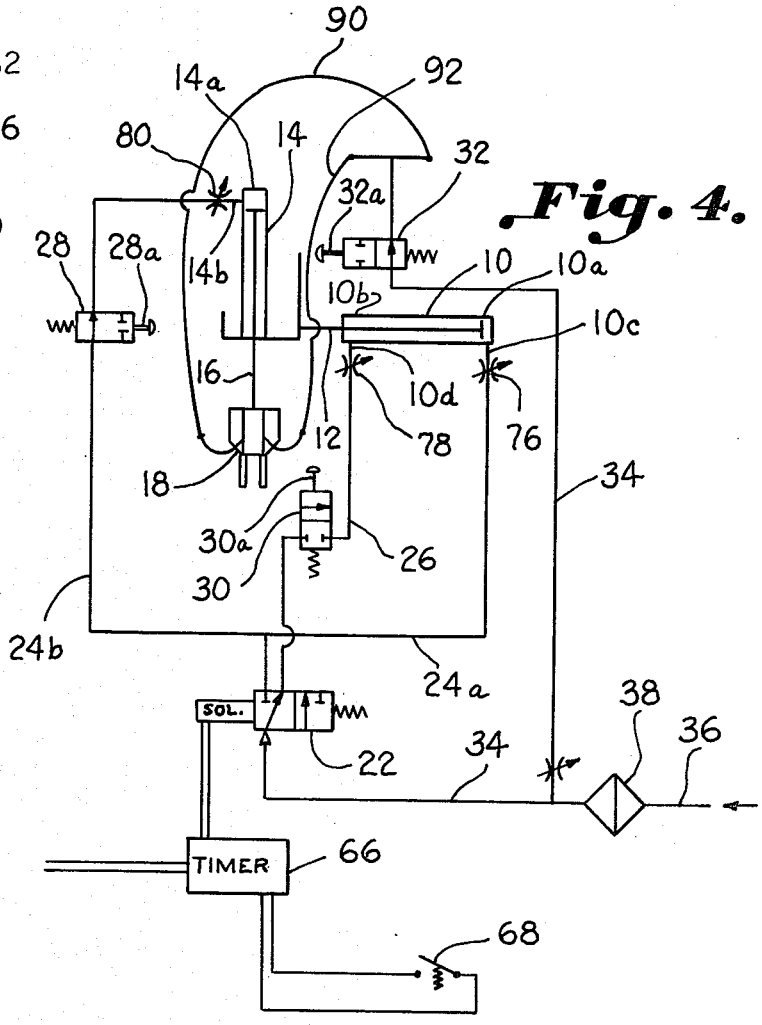
FIG. 4 is a schematic diagram illustrating a fluid control circuit for controlling the stay feeder apparatus in an automatic manner.
Figure 5:
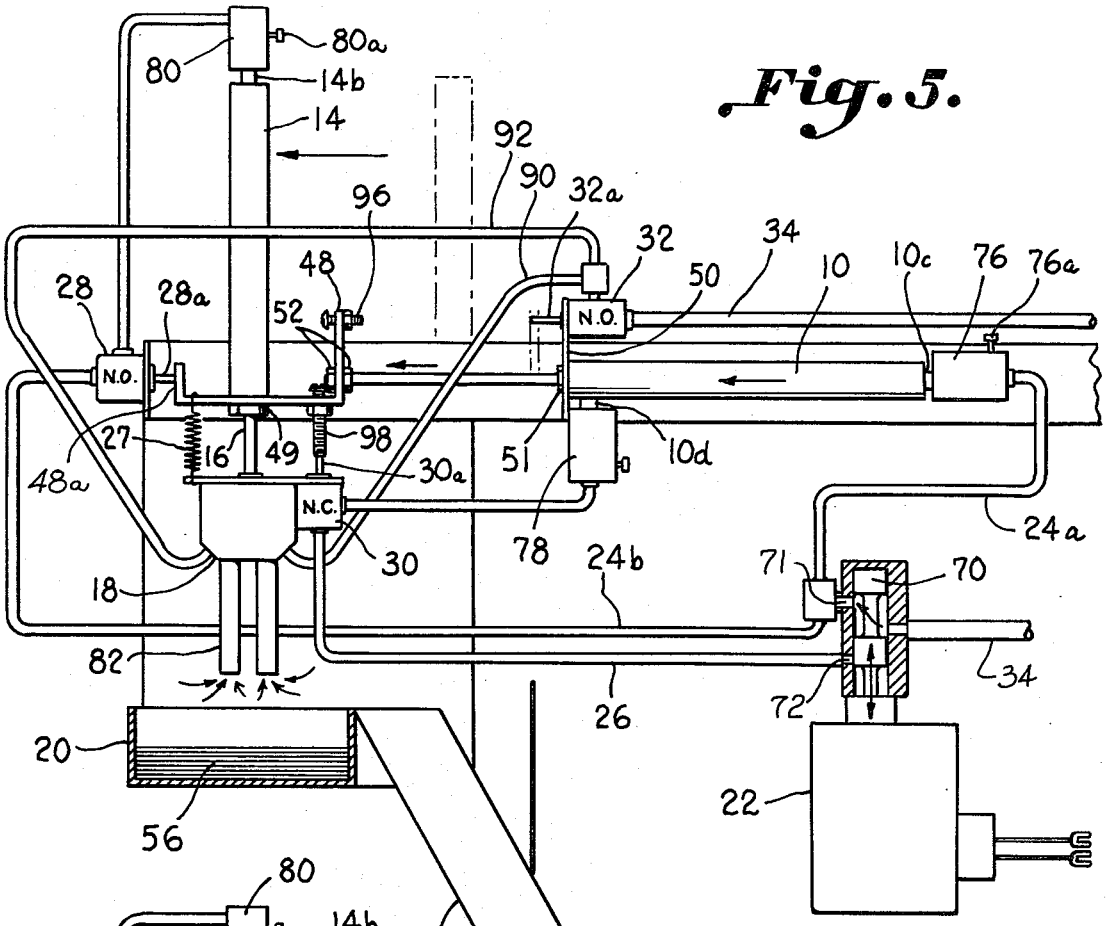
FIG. 5 is a schematic front elevational view of an automatic stay feeder apparatus according to the invention wherein features of the apparatus are shown schematically and arranged in different positions for clarity in illustrating the operation of the invention.
Figure 6:
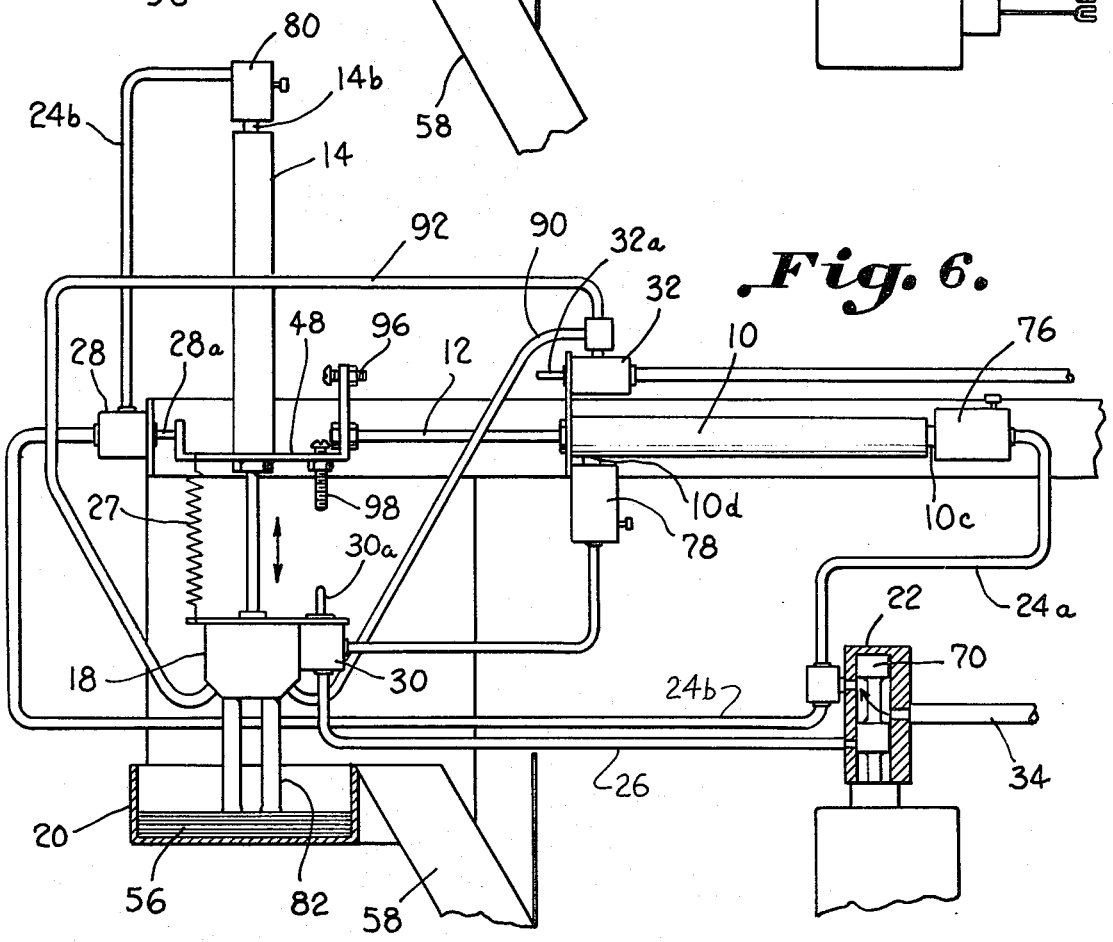
FIG. 6 is a schematic front elevational view of an automatic stay feeder apparatus according to the invention wherein certain features are rearranged and schematically shown for clarity in illustrating the operation of the invention.

The operation of the stay feeder apparatus will now be described to ensure a clear and complete understanding of the invention which can best be had by referring to FIGS. 3 through 6. In FIGS. 4 and 6, certain elements of the feeder apparatus have been re-arranged in their locations for the sake of clarity in illustrating the operation thereof.

First, the feeder apparatus will be described in a de-energized condition. With the solenoid valve 22 in a deenergized position, the spool valve 70 assumes the second position wherein pressurized fluid is delivered by way of conduit 26 to the valve means 30. However, since the apparatus is in a de-energized condition, the suction device 18 is at a home position with piston rod 12 fully to the right which corresponds to the stay delivery position "b". At this position, an adjustable abutment screw 96 on the carriage member 48 engages the switch pin 32*a* of the switch 32 to close the normally open valve 32, thereby preventing delivery of pressurized fluid to the suction device 18 from source line 34. Also, in this position, the normally closed valve 30 is opened since the switch pin 30*a* is depressed by an adjustable abutment in the form of a turn screw 98 which is carried on the carriage member 48. Thus, with the valve 22 in its second position, fluid is delivered to the inlet 10*d* of cylinder 10 holding the carriage 48 in an extreme right position in the slot 46 maintaining the suction device in the home position. It is to be noted that no fluid is delivered to the cylinder inlet 10*c* or 14*b*.

The adjustable abutment screws provide for adjusting the timing of the closure or opening of the valves 30 and 32 in response to the movement of the suction device 18 and carriage member 48.

When it is desired to initiate the sequence for picking up a collar stay from the magazine 20 and delivering it to the feed chute 58, the foot switch 68 is depressed actuating the timer 66. In its initial sequence, the timer energizes the solenoid valve 22 moving the spool valve 70 to the first position wherein pressurized fluid is delivered to the inlet 10*c* of cylinder 10 and inlet 14*b* of cylinder 14. The fluid delivery is by means of conduit lines 24*a* and 24*b* and normally open valve 28. As the suction device 18 begins to move to the left under the influence of cylinder 10, it simultaneously moves downward under the influence of cylinder 14 and the switch pin 32*a* of valve 32 is released opening the valve to deliver pressurized fluid to the suction device 18. Essentially, simultaneously with the suction tubes 82 arriving at the stay pick-up position "a" and contacting a stay 56 in magazine 20, an abutment 48*a* of the carriage member 48 actuates the switch pin 28*a* of valve 28. This closes valve 28 and allows return of the suction device 18 upwardly under influence of the return spring 27.

The timer device 66 enters the second and final sequence of control of valve 22 substantially simultaneously with the ascent of the suction device 18 whereby it de-energizes the solenoid valve 22 terminating fluid delivery to the cylinder inlets 10*c* and 14*a* while initiating delivery of fluid to the inlet 10*d* of cylinder 10. As the switch pin 30*a* of valve 30, which travels with suction device 18, engages the abutment screw 98, the valve 30 is opened permitting the pressurized fluid to be delivered from valve 22 to the inlet 10*d* of cylinder 10 moving the suction device 18 to the right until reaching the stay delivery position. On reaching the stay delivery position, the abutment screw 96 engages the switch pin 32*a* of valve 32 closing the valve and terminating suction in the suction device 18 causing release of the stay held thereby and delivery through the hopper and chute assembly 58. The sewing machine operator, after having sewn in the collar stay, will again hit the switch pedal 66 to again send the automatic feeder apparatus through its sequence to deliver another collar stay.

The entire pick-up and delivery sequence can last as little as one and a-half seconds. The distances by which the suction pick-up device 18 is moved are actually very short. Utilization of valve 30 ensures that the suction device 18 is raised to its full extent before moved to the right in order to clear the magazine 20 and hopper 58 with a stay.

It is to be understood, of course, that while a suction device has been illustrated for picking up collar stays from the magazine 20 that other pick-up means may be utilized such as a magnetic means for picking up wire type collar stays. It is also contemplated that the magazine 20 be spring-loaded so as to always assure that the top collar stay is at a given position whereby suction device 18 will contact the top collar stay at the same height as it descends to the stay pick-up position.

Thus, it can be seen that an advantageous construction can be had for an automatic stay feeder apparatus which may be operated by compressed air or other suitable fluid. Control of the pick-up and delivery sequence is had by actuating the various control valves by engagement with and movement of the carriage member and suction device which ensures that the device is at the proper position before advancing to the next. Thus, the stay pick-up device, which is illustrated in the form of a unique suction device, is automatically moved from a home position to a stay pick-up position and returned to a stay delivery position in response to the movement of the suction device itself. The timing of the movement of the suction device may be adjustably regulated so that the timing and positioning of the device is achieved to provide errorless pick-up and delivery of the collar stay without malfunction.

While a preferred embodiment of the invention has been described using specific terms, such description is for illustrative purposes only, and it is to be understood that changes and variations may be made without departing from the spirit or scope of the following claims.

What is claimed is:

1. Automatic feeder apparatus for feeding collar stays to an associated sewing device and the like comprising:

a first fluid cylinder having a pair of inlets and a laterally reciprocating piston rod extending therefrom;

a second fluid cylinder having an inlet and a vertically reciprocating piston rod extending therefrom;

carriage means carried by said piston rod of said first fluid cylinder, said second fluid cylinder being carried by said carriage means;

a pick-up device carried by said piston rod of said second fluid cylinder for picking up a collar stay from an associated magazine;

first valve means having a first position for delivering a fluid from a pressurized fluid source to one of said inlets of said first cylinder and said inlet of said second cylinder to move said pick-up device in first and second directions, respectively, to a stay pick-up position;

said first valve means having a second position for delivering the fluid to the other of said inlets of said first cylinder to move said pick-up in a third direction opposite to said first direction to a stay delivery position;

fluid supply conduit means connecting said first valve means and said inlets of said first and second fluid cylinders for delivering said fluid;

second valve means connected in said fluid supply conduit means between said first valve means and said inlet of said second cylinder responsive to said pick-up device reaching the end of lateral movement at a predetermined lateral position in said first direction for terminating fluid delivery to said second cylinder; and third valve means connected in said fluid supply conduit between said first valve means and said other inlet of said first cylinder responsive to said pick-up device reaching the end of vertical movement at a predetermined vertical position in a fourth direction opposite to said second direction for allowing delivery of fluid to said other inlet.

2. The apparatus of claim 1 wherein said pick-up device includes a suction device and wherein said apparatus includes a fourth valve means for controlling delivery of a fluid to said suction device, said fourth valve means responsive to said suction device reaching the end of movement at said stay delivery position for terminating fluid flow to said suction device.

3. The apparatus of claim 1 wherein said second valve means is actuated by movement of said carriage means.

4. The apparatus of claim 3 wherein said third valve means is actuated by movement of said pick-up device.

5. The apparatus of claim 1 including regulator means for regulating the rate of movement of said pick-up device to provide proper positioning of said pick-up device at a correct time for stay pick-up and delivery.

6. The apparatus of claim 5 wherein said regulator means includes an adjustable flow regulator connected in said conduit means adjacent each said cylinder inlet for regulating the flow rate of fluid delivered thereto.

7. The apparatus of claim 1 wherein said piston rod of said second cylinder includes a single action spring-return air operated piston rod.

8. The apparatus of claim 1 wherein said pick-up device comprises a suction device including at least one suction tube having a suction end and a pressure end, a fluid delivery inlet communicating with an interior bore of said suction tube, said fluid inlet connected to said fourth valve for delivering a fluid from a pressurized fluid source to said bore intermediate the ends thereof and outwardly from said pressure end creating a suction at said suction end.

9. The apparatus of claim 8 wherein said suction end includes a resilient tip carried by said suction tube for sealing and maintaining suction on said stay.

10. The apparatus of claim 1 wherein said pick-up device includes a suction device having a pair of suction tubes for independently engaging said collar stay at spaced points.

11. Automatic feeder apparatus for feeding collar stays to an associated sewing device and the like comprising:

a first fluid cylinder having a laterally reciprocating piston rod extending therefrom;

a second fluid cylinder carried by said first fluid cylinder having a vertically reciprocating piston rod extending therefrom;

a suction device carried by said piston rod of said second cylinder for picking up a collar stay from an associated magazine;

first valve means having a first position for delivering fluid from a pressurized fluid source to one end of said first and second cylinders to move said suction device in first and second directions, respectively;

said first valve means having a second position for terminating said delivery of fluid to said first and second cylinders;

fluid supply conduit means connecting said first valve means and said first and second cylinders;

means for moving said suction device laterally in a third direction opposite to said first direction;

means for moving said suction device vertically in a fourth direction opposite to said second direction;

second valve means for controlling delivery of fluid from a pressurized fluid source to said suction device; said second valve means responsive to said suction device reaching a predetermined lateral position in said third direction for terminating fluid delivery to said suction device causing release of said stay; and a third valve means connected between said first valve means and said other end of said first cylinder including switch means responsive to vertical movement of said suction device in said fourth direction for delivering fluid to said other inlet of said first fluid cylinder causing said suction device to move laterally in said third direction upon reaching a desired vertical position.

12. The apparatus of claim 11 wherein said means for moving said suction device in said fourth direction includes a spring for returning said piston rod of said second cylinder.

13. The apparatus of claim 11 wherein said means for moving said suction device in said third direction includes means for delivering fluid to said other end of said first cylinder.

14. The apparatus of claim 11 including electrical timer means for controlling movement of said first valve means which includes a solenoid operated valve.

15. The apparatus of claim 11 including manually operated switch means for controlling movement of said first valve means.

16. The apparatus of claim 11 wherein said suction device includes a pair of laterally spaced suction tubes each said tube having a suction end and a pressure end and a fluid inlet for delivering a fluid through each said tube creating a suction at said suction end.

17. The apparatus of claim 11 including adjustable flow regulator means connected between said first valve means and each said cylinder for regulating the rate of movement of said suction device.

* * * * *